United States Patent [19]

Lancelot, III et al.

[11] 4,204,711

[45] May 27, 1980

[54] COUPLING FOR LIFT SYSTEM FOR CONCRETE SLABS

[75] Inventors: Harry B. Lancelot, III; Robert M. Macrobbie, both of Fort Worth, Tex.

[73] Assignee: Brown Company, Pasadena, Calif.

[21] Appl. No.: 926,286

[22] Filed: Jul. 20, 1978

[51] Int. Cl.[2] ..... B66C 1/00

[52] U.S. Cl. ..... 294/89; 52/707

[58] Field of Search ..... 294/89, 86 R, 78 R, 294/93, 94, 87, 92; 52/699, 700, 701, 704, 706, 707, 708, 711, 122, 125, 126

[56] References Cited

U.S. PATENT DOCUMENTS

| | | | |
|---|---|---|---|
| 3,680,906 | 8/1972 | Neumeier | 294/89 |
| 4,017,115 | 4/1977 | Holf et al. | 294/89 |
| 4,018,470 | 4/1977 | Tye | 294/89 |
| 4,123,882 | 11/1978 | Cage et al. | 294/89 |

*Primary Examiner*—James B. Marbert

*Attorney, Agent, or Firm*—Smyth, Pavitt, Siegemund, Jones & Martella

[57] ABSTRACT

A flared tube sitting on a base is embedded in a concrete slab, and a casement on a shackle can be inserted into the tube to make up the coupling. The casement holds a plunger which can be locked into a position in which its head urges balls out of the casement for engagement with the flare tube. The plunger lock includes a fork locking the casement to the plunger at the other end. The plunger head has a conical tip so that upon retraction the balls can be retracted to release the coupling or to insert the casement to make up the coupling. The flared tube is clamped down onto the base which in turn is constructed for fastening to re-bar structure in the concrete.

23 Claims, 11 Drawing Figures

70
73
66
77
68
76b
83
45
80
67
78b
79
76b
75
78a
75
76a
80
82
85
40
46
48
48

70
58
71
60
61
73
62
66
65
64
43
45
44

56
50
40
41
42
57
51
46
48
48
54
53
46

56
40
51
54
46
7
7
53
48

58

70
61
73
66
60
62
66
49a
49b
63
43
65
64

COUPLING FOR LIFT SYSTEM FOR CONCRETE SLABS

BACKGROUND OF THE INVENTION

The present invention relates to coupling structures to permit concrete slabs to be lifted, tilted, hoisted or otherwise handled by means of suitable equipment such as cranes.

Coupling structures of the type to which the invention refers are known in general. Usually they are comprised of an anchor part which is embedded in the concrete and forms a socket opening. This anchor part cooperates with a release type coupling element which can be connected to the anchor part and released therefrom. The hoisting, lifting or other equipment is connected or connectible to that release type coupling element so that this equipment can move the concrete slab when the coupling is made up, but slab and equipment can be separated upon release of the coupling.

A typical example of this type of coupling is disclosed for example in U.S. Pat. No. 4,017,115. Simplified versions are contained in U.S. Pat. No. 3,680,906 and 3,652,118, which do not, however, show quick release type constructions. The principle of a quick release type coupling is, of course, quite old and known in numerous versions. Common to these is that a displacement element is placed behind a shoulder or the like to complete the coupling. However, it is not believed that release type couplings for use with concrete parts and requiring, therefore, very sturdy construction, are known at the required degree of simplicity deemed essential for handling.

DESCRIPTION OF THE INVENTION

It is an object of the present invention to provide a new and improved coupling structure which is to include an anchor part to be embedded in concrete, and a release part which together with the anchor part permits making up the coupling to connect hoisting, lifting or other equipment to the concrete part while upon release of the coupling, the lifting equipment and concrete part are separated.

In accordance with the preferred embodiment of the invention, it is suggested to construct the anchor part to have the configuration of a flared tube mounted on a base and being embedded in concrete. The flared tube has a tubular neck for access and insertion of the release coupling part. The release coupling part includes a casement held in the lifting equipment such as a shackle. The casement contains a plunger having a head which holds balls in a position of radial projection in and from lateral bores in the casement. These balls are otherwise freely movable as such though over a limited displacement range. The plunger is held and locked normally in a forward position in which its head causes the balls to protrude. The position lock, however, is spring-biased as to the plunger to permit resilient yielding of the plunger and to prevent binding thereof. In order to release the coupling, the plunger must be released and retracted. Releasing the lock permits retraction of the plunger by a lever so that the casement can now be withdrawn by means of the lifting equipment; the balls will recede into their openings, clearing the neck of the anchored tube.

A significant aspect of this coupling is that coupling proper is effected by the balls being simply held in a protracted position and engaging the flared anchor part so that the forces exerted upon tension loading the coupling are laterally reacted directly into the concrete. Coupling does not depend on mutual aligning of particular shoulders by the coupling is made up by displaceable balls which retract (protract) upon plunger retraction (protraction) and are held by plunger head in the protracted position. The balls are not linked or otherwise connected to the plunger, but they are actuated, held, and displaced simply be engagement of the individual balls with the periphery of the plunger or its conical end, depending on the axial position of the plunger.

The plunger is locked into the forward or down position by a releasable retaining or restraining means being preferably a bushing on the plunger stem held by a fork which locks the bushing and the stem in position. The plunger head and stem can now axially be displaced i.e. retracted only by compression of the spring which is interposed between the locked bushing and the stem. Under load from a concrete slab the spring is biased as the protruding balls are urged inwardly against a steep, frustoconical portion of the plunger when in the down position, urging the plunger up a little but retaining the balls in the protruding position to make up the coupling. Load variations cause the spring to resiliently react and the plunger is thus moved slightly back and forth. Consequently, there is frequent movement between the plunger head and the balls. Removal of the fork releases the lock (bushing) and the plunger can now be retracted by the prying or retraction lever.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
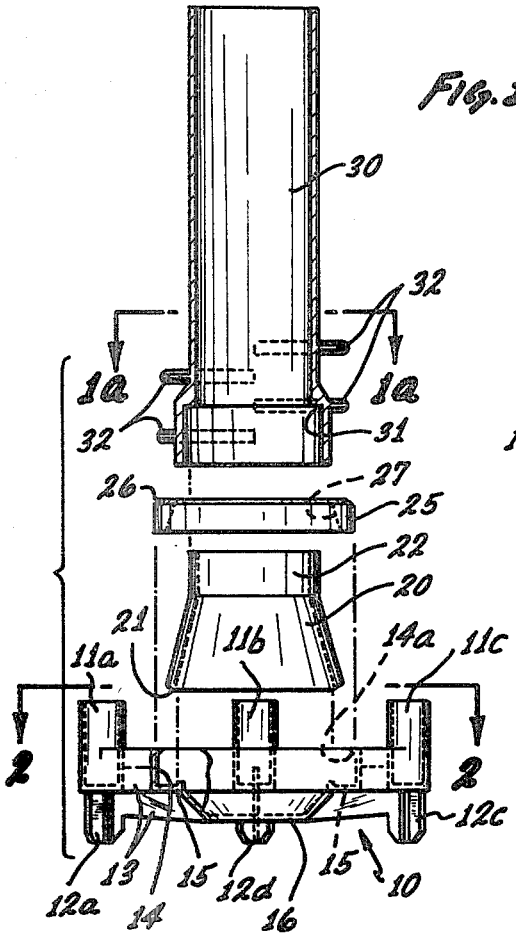
FIG. 1 is an exploded side view of the anchor assembly in accordance with the present invention.
Figure 2:
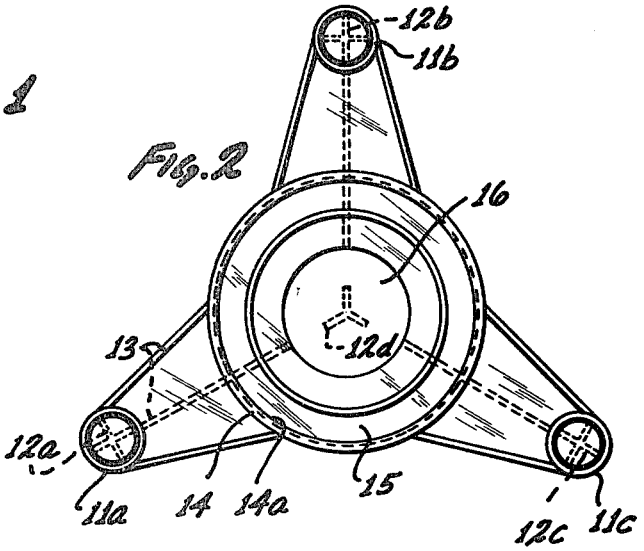
FIG. 2 is a top elevation of a base part as seen from a plane indicated by lines 2—2 in FIG. 1.

Proceeding now to the detailed description of the drawings, reference is made first to that part of the lifting system which is to be embedded in the concrete slab to be lifted, hoisted or handled otherwise. That part is shown in FIGS. 1 and 2, and includes a plastic base member 10 which, in a top elevation, has an overall star-shaped configuration. The ends of the star are formed by three sleeves 11*a, b, c,* each having a bottom of open construction in that each of these corner elements has a foot portion 12*a, b, c,* of cross-like configuration in cross-section. The three corner elements each are provided, for example, to receive re-enforcing bars to be embedded in the concrete. In addition to the physical properties the star bases may be stacked on top of one another by placing the foot portions into the three corner elements for storage.

The base includes further a web structure 13, joining the corner elements and including particularly a short, sleeve-like annulus 14 with an internal flange 15. The sleeve 14 may have a lip or bead 14*a*. A flat dish or pan—like portion 16 extends down from the flange 15. A fourth foot 12*d* supports a dish 16.

Upon assembly for insertion or embedding in concrete, a flared insert 20 made for example of steel is seated on flange 15 in that the edge 21 of insert 20, being the portion of widest diameter, rests on the flange 15. The insert 20 has a cylindrical neck portion 22 being integral therewith. The flared end of the member 20 may be bonded to sleeve 14 by means of a suitable adhesive. After the insert 20 has been seated as stated, a seal ring 25 may be slipped over the neck 22, down the flared portion and inserted into the sleeve 14 in that a bevelled edge 26 of the ring 25 snaps under lip 14*a* or simply slips in adjacent to the sleeve 14. A frustoconical inner wall 27 of ring 25 firmly engages the insert 20 from the outside and holds it on the base 10 and against sleeve 14 by clamping and wedging action.

The interior of the insert 20 must not be filled with concrete. Bottom pan 16 prevents such inflow from below. Additionally, a plastic sleeve 30 is stuck with its end onto the neck 22 of the insert, whereby an internal shoulder 31 of sleeve 30 engages the outer axial end of the neck 22. The sleeve is provided with ribs 32 which will engage the concrete which is, e.g. poured all around the sleeve 30. These ribs prevent the sleeve from slipping out of the concrete. Moreover, these ribs 32 may engage horizontally running concrete reinforcing bars and that engagement, in turn, prevents the rather lightweight base 10 with insert 20 and sleeve 30 from floating up in the liquidous concrete as it is being poured.

The length of the sleeve 30 is chosen so that its upper end is almost flush with the surface of the concrete slab into which the entire assembly as per FIG. 1 will be embedded. A plastic cap (not shown) may be placed on top of sleeve 30 having upstanding fingers to better indicate the location of the insert in the concrete slab. The cap prevents concrete from accidentally filling the sleeve but will be removed when the coupling is made up.

Figure 3:
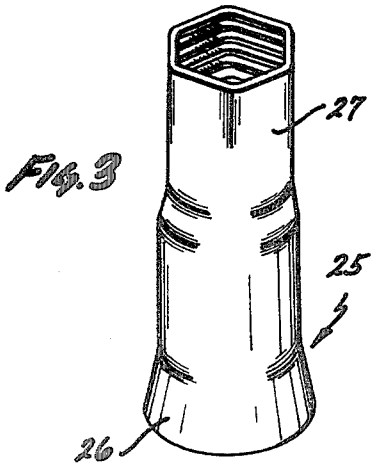
FIG. 3 is a perspective view of a modified concrete insert.
Figure 1A:
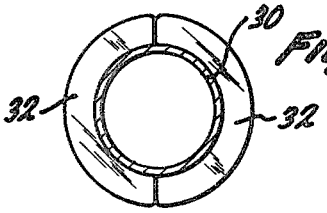
FIG. 1*a* is a section view as indicated by line 1*a*—1*a* in FIG. 1.

FIG. 3 illustrates a somewhat simpler, or at least modified, insert 25. This particular insert may, but does not have to be used on a base such as 10. Insert 25 has a flared portion 26 and an elongated neck 27. The neck-end 27 of insert 25 is of appropriate geometry for threading to receive a threaded bolt which in turn is connected or connectible to lifting equipment. Alternatively, insert 25 may serve as coupling part similar to part 20, for lifting the concrete slab in which this insert 25 is embedded.

In the preferred form the embedded and anchored assembly, as shown particularly in FIGS. 1 and 2, co-acts with a lifting bolt mechanism depicted in detail in FIGS. 4 to 8. The mechanism includes a casement 40 being of elongated construction. The casement 40 has a cylindrical bore 41 with wider diameter portions on both ends, establishing shoulders 42 and 43, respectively. Approximately half of the length of the casement is provided with a threading 44 being cut into the outside of the casement. A tie down nut 45 is threaded onto the casement.

Figure 4:
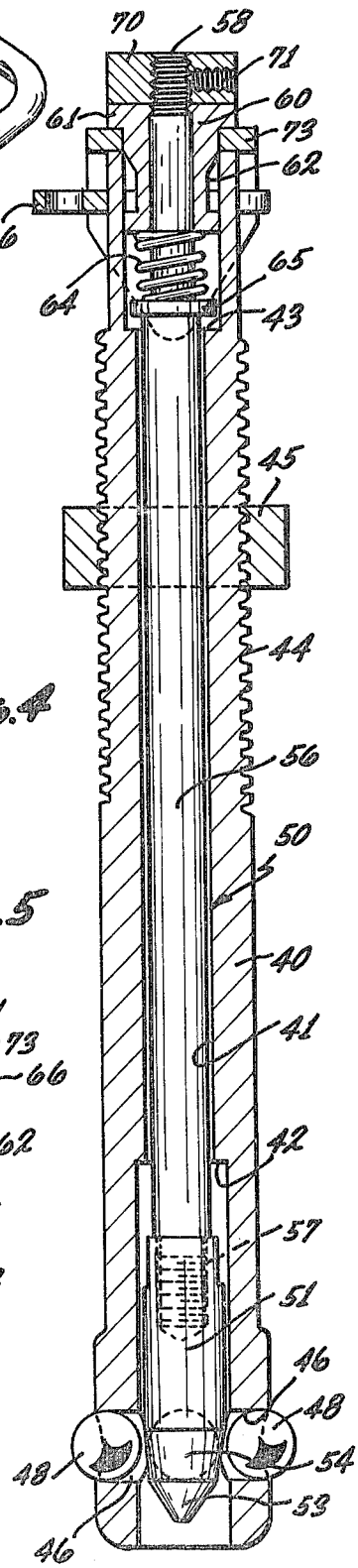
FIG. 4 is a section view into a releasable coupling member constructed in accordance with the preferred embodiment.
Figure 6:
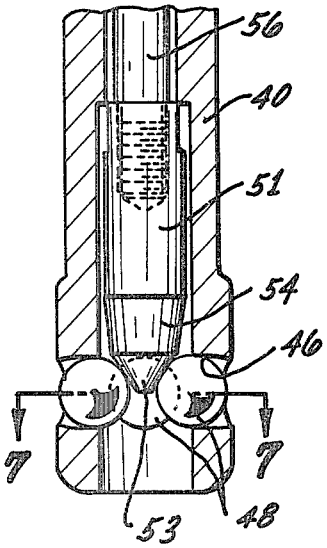
FIG. 6 shows a portion of the member as shown in FIG. 4 but in a different operating state.
Figure 5:
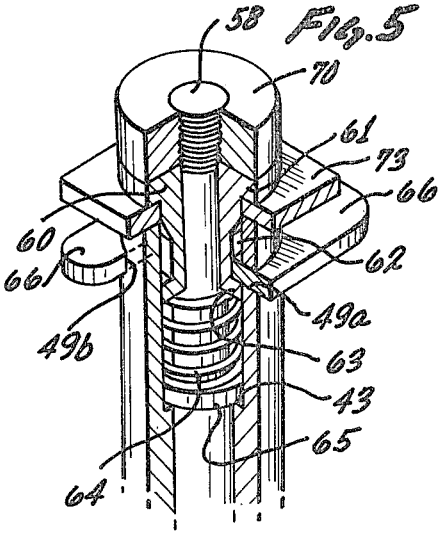
FIG. 5 is an enlarged detail of FIG. 4.

One end of the casement 40 is provided with four radial bores 46 facing each other in pairs across the diameter of the bore 41. Each bore contains a ball 48 of the type used in ball bearings. Each bore 46 has a slightly flared end 47 to prevent the ball from falling out (see FIG. 7). Thus, a ball 48 may project or protrude laterally, i.e. radially, outwardly from casement 40, to the extent permitted by the flare 47. FIG. 4 shows the balls in the extended or protruded position. The dimensions are so chosen that all balls can retract fully and will not project beyond the outer dimensions of the casement 40.

Before continuing the description of the casement 40, reference is made to a plunger 50 contained in the casement. The plunger is a two-part device having a stem 56 with front end threading 57 and rear end threading 58. The head part of the plunger is an expander arbor 51, having a threaded bore 52, a blunted cone 53 at the front end, a steep frustocone 54, and cylindrical portion 55. The front end of the stem, threading 57 is threaded into the bore 52.

FIG. 4 shows the plunger in normal position in that the operating head 51 forces all of the balls 48 into the radially outwardly protruding position. Upon retraction of the plunger (FIG. 6), the balls may retract. Cone 53 when advancing, forces the balls into protracted positions in which they will be held by the steep cone portion 54 of head 51, until the plunger retracts.

The other end of stem 56 carries the following assembly. A traveling bushing 60 is received by the unthreaded portion of stem 56, underneath threading 58. The bushing 60 has a head 61 which is sandwiched between a lock nut 70 and a retractor lever 73, having an aperture also to be traversed by stem 56. The nut 70 is threaded onto the threaded end 58 of stem 56 and is flush with the stem end proper as shown. The nut is locked to the stem by a set screw 71. The retractor lever 73 is an angle piece and sits on the upper end of casement 40. The bent down portion of lever 73 is tied to a lanyard 68 for manipulation and prying.

The bushing 60 has an annular slot or groove 62, bounded by a tapered portion to one (axial) side and by a flange 63 on the other side. A spring 64 bears against that flange from below. The other end of the spring 64 is held by a bushing 65 whose axial end flange sits on a shoulder 59 of stem 56. However, bushing 65 could be eliminated and the spring 64 could be seated directly on the shoulder 59. The dimensions are so chosen that in the illustrated position of FIG. 4, spring 64 is relaxed. In other words, the combined axial lengths of the parts 60 and 70, nut 70 having been screwed on flush with the end of stem 56, is chosen so that shoulder or flange 63 is spaced from shoulder or flange 65 by a distance failing to compress the interposed spring 64.

The casement has two recesses 49*a, b,* which receive the prongs of a flat fork element 67. The spacing between the prongs of the fork is about equal to the diameter of the cylindrical portion of bushing 60 (recess 62). The thickness of this fork is a little smaller than the axial dimensions of the cylindrical portion of groove 62. Thus, the fork can be freely inserted, and its prongs straddle the bushing 60.

The plunger is assembled and positioned and locked in the casement as follows. The tip, head or expander arbor 51 is threaded onto the threaded end 57 of stem 56, and they are inserted through the lower end of casement 40, end 58 first. The balls 48 have been inserted earlier and are movable to the extent the tapers 47 permit. Plunger 50 can be inserted into the casement until the arbor head 51 abuts shoulder 42.

Next, bushing 65 is slipped onto the stem until seated on shoulder 59 (off shoulder 43), and the spring 64 is put in place. In the meantime, traveling bushing 60 has been inserted into the bore of lever 73 and its shoulder 61 sits on that lever. Together, bushing 60 and lever 73 are slipped onto shaft 56 until shoulder 63 sits on spring 64 and lever 73 sits on the upper casement end. Finally, lock nut 70 is threaded onto the threaded end 58 of stem 56 and set screw 71 locks the nut 70.

It can readily be seen that without fork 66 being inserted plunger 50 can be pushed up from the position illustrated in FIG. 4; shoulder 59 carries the assembly 60, 64, and 65 and, of course, nut 70 is carried by the stem; head 61 will lift off lever 73 which rests on the casement. On the other hand, the down position of the plunger 50 as shown in FIG. 4, is established in that the plunger 50 is suspended by nut 70; the nut rests on flange 61 of bushing 60, which, in turn, rests on lever 73 which sits on the casement 40. Fork 66 can be inserted into the slots, 49*a, b,* whereby its prongs enter the groove 62 behind the upper shoulder of flange 63. As far as the lower end of the plunger is concerned, balls 48 are pushed outwardly and held by the tapered, but near cylindrical surface 54 of arbor 51.

Fork 66 when inserted, locks the bushing 60 in position and the bushing cannot be lifted. Therefore, lever 73 cannot be lifted either. Still, the plunger can be lifted, but upon any lifting, bushing 62 is carried up and will cause the spring 64 to compress. The spring can be compressed fully only when the plunger 51 is acutally forced upward. Thus, the plunger is yieldingly retained and restrained by bushing 60 which is positively locked. The stroke length the plunger may undergo for full compression is not sufficient to place the balls 48 into the range of the cone 53.

Figure 9:
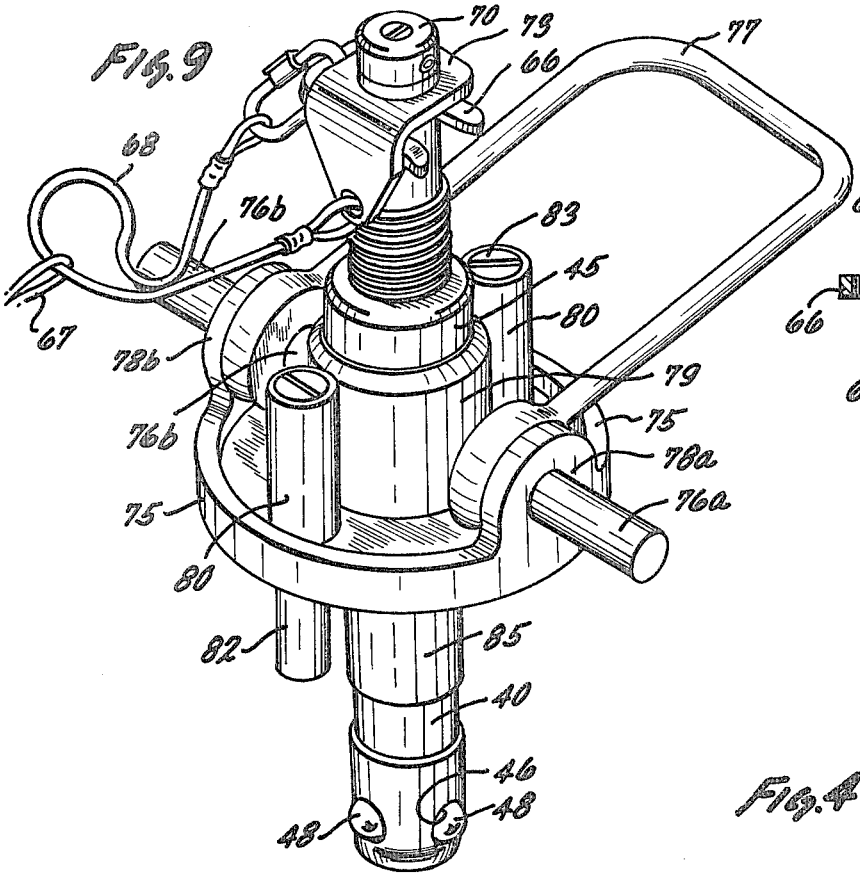
FIG. 9 is a perspective view of the completed assembly of the parts shown in FIG. 8.
Figure 8:
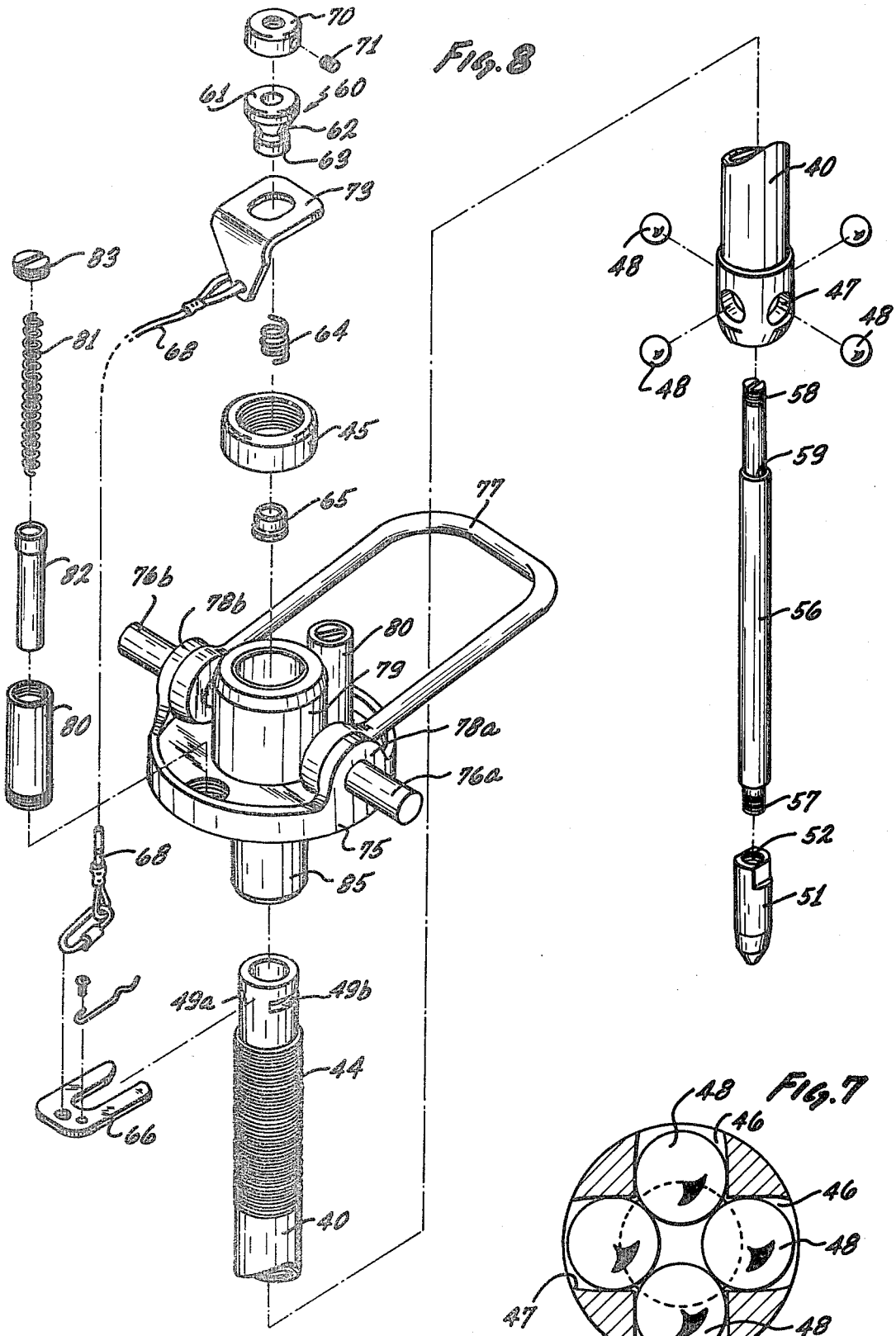
FIG. 8 is an exploded view of the removable part of the coupling and of the lifting device (shackle) as connected thereto.
Figure 7:
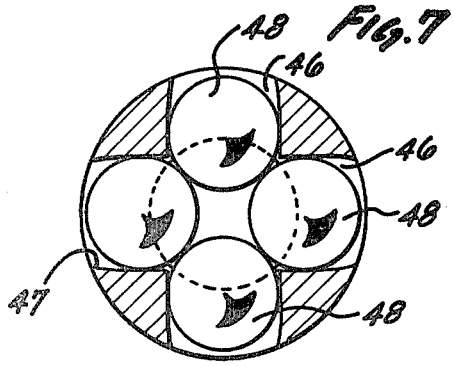
FIG. 7 is a section view as indicated by line 7—7 in FIG. 6.

Before describing in detail how the coupling is made up and released, we turn to the description of additional elements for a completed assembly. FIGS. 8 and 9 show that the casement 40 is inserted in a shackle plate 75 having a central sleeve or hub in which the casement is inserted. As the nut 45 is threaded onto the casement, the latter hangs in the shackle. Lift or shackle plate 75 carries additionally ejection housings 80, telescopically receiving tubular ejector plungers 82, being spring-biased by means of ejector springs 81. The plungers 82 are closed at the bottom, the housings 80 are closed on the top by threaded caps 83. Cooperating shoulders prevent the plungers 82 from falling out of the housings 82 when the shackle is not attached. A bail 77 is pivoted by means of pins 76*a, b,* in eyes 78*a,b.* These pins are extended so that a person may stand on them, pushing the shackle down against the tension of the springs 81. A suitable cable will be attached to bail 77. Ejection housings 80 are threaded into plate 75 and can be removed.

The casement 40 does not fit tightly into the shackle sleeve 79. Rather, a downwardly protruding shear tube 85 is interposed. This tube 85 is spring-biased and urged down by a spring 87. This spring is interposed between a top shoulder 85*a* of the tube 85 and a ring 86 which sits in hub 79 and is retained by press fit. Casement 40 can easily clear the rig 86. A shoulder 79*a* prevents sleeve 85 from falling out. The purpose of tube 85 will be described shortly.

Figure 10:
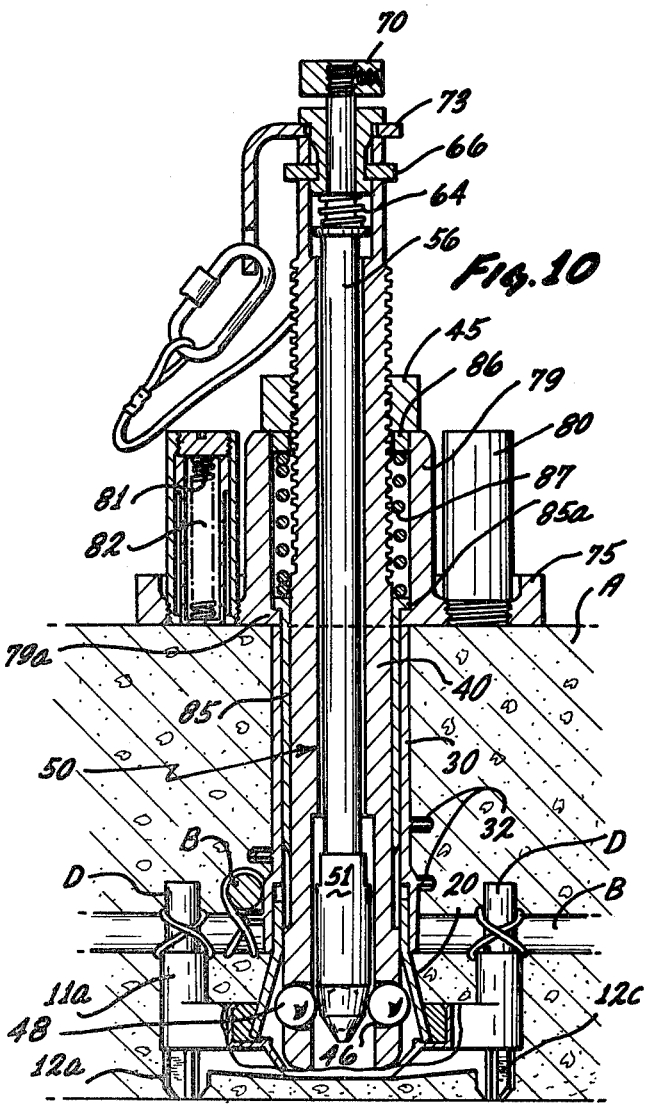
FIG. 10 is a section view of the completed and made up coupling.

FIG. 10 shows the completed assembly; the coupling has been made up. The base 10 with insert 20 tied down and held in place by the ring 25, is embedded in the concrete of a slab A. Reinforcing bars such as B constitute a substructure and traverse the concrete, possibly forming a mesh, and dowels such as D are tied thereto and inserted into the pockets of the corner elements of base 10, to thereby hold and position the base 10, particularly prior to and during the pouring of the concrete. The sleeve 30 is stuck onto the neck 22 of insert 20. The anchor assembly may be held in place in the concrete (as long as the concrete is soft) in that one or the other of the ribs 32 lodges under one of the horizontal reinforcing bars B. The interior of insert 20 is kept free from concrete during pouring by the sleeve 30 and by a cap which was placed on top of sleeve 30. These parts remain in place and constitute permanent fixtures of the slab. The interior of 20 and 30 may afterwards be filled with concrete or any other filler if that is desired.

FIG. 10 shows also the inserted lifting bolt mechanism, and it can be seen that the casement 40 has been inserted into the tubular assembly 20, 30, and the coupling is made up. Prior to completing the coupling, the subassembly shackle-casement-plunger was assembled such as shown in FIG. 9. The plunger hangs in the casement and for convenience may be locked by inserted fork 66; the casement hangs in the shackle and is held by nut 45.

The casement can be inserted into the tubes 30 and 20 only when balls 48 are permitted to retract. Thus, the plunger 50 has to be retracted so that the balls are free and the front end portion of the casement can, in fact, pass through the neck 21. Therefore, the insertion of the casement-plunger-balls subassembly requires that fork 66 be removed so that the plunger 50 can be freely liften in the casement 40. Balls 48, when urged radially inwardly by the tubes 30 and 22, cause the stem 56 to move up by operation of the dual taper 54 and 53.

After the casement has been inserted, the shackle has to be pushed down so that the plate 75 can sit on the concrete slab. Force is required because the protruding tubes 82 have to be forced into tubular housings 80 against the force of the springs. The tie down nut 45 has been threaded up to be located near the upper end of the casement threading 44. In some instances, such as a lateral insertion of the coupling into an upright surface of the slab, spring bias of the plate 75 may be impractical and housings 80 will be removed. After the coupling has been made up housings 80 with compressed springs may be threaded into plate 75 to prepare the device for later uncoupling.

As soon as the front part or lower end of the casement enters the flared portion 20 of the insert, the weight of the plunger stem forces the balls 48 out, and the plunger assumes again the disposition of FIG. 4. Now, fork 66 can be put in place which locks the plunger and the balls 48 in the protracted position. As the shackle plate 75 is placed down and the nut 45 is in a threaded up position, the casement 40 projects deeper into tube 20 (neck 22) than in the final state. Now, nut 45 is tightened against hub 79 which, in turn, tightens the protracting balls 48 into engaging position with the flared insert 20.

The shackle can swing about the pins 76*a, b,* and a cable, crane, hook, or the like can be affixed to the bail to pull the shackle in any desired direction, in and away from the surface of the concrete slab. The shear tube 85 is interposed between casement 40 and tube 30 and has the following purpose. The bottom of the shackle plate 75 is spaced from the balls 48 commensurate with the depth of embedding the assembly 10, 20. This depth may vary so that casement 40 must be differently positioned in shackle 75. Tube 85 makes sure that the threading 44 does not come in contact with the concrete. Moreover, the threading 44 should not be worked into the plastic tube 30. Thus, shear tube 85 is interposed between casement 40 and the insert assembly 10, 20 whereever needed. Shear tube 85 slides up and down in hub 79. The shear tube is of a length suitable for all slab thickness. It is a self-setting shear tube by operation of spring 87. The spring 87 prevents that protective tube 85 be shifted up during manipulation and operation of the shackle-plus-casement assembly.

Casement 40 and shackle plate 75 are held in position on the concrete slab by clamping action of the nut 45 on the one hand, and by the protracted balls 48 engaging tube 20 on the other hand. It can readily be seen that any pulling force acting on the shackle and the casement 40 is reacted by the balls 48 into the flared portion 22 of the tube 20. These forces are taken up directly by the concrete and they act in the concrete at a rather flat or shallow angle relative to the surface of the concrete material. The force component towards the surface is comparatively small. The concrete slab can now be manipulated through cable or the like attached to bail 77.

In addition, any force acting on the casement in this manner, i.e. any interaction of forces between flared tube 20 and the balls 48 under load exhibits the following additional effect. The balls 48 act on the steep taper 54, and will force the plunger 50 up. The resulting retraction of the balls is slight because the frustocone 54 is very steep. As a consequence, stem 56 is moved up and spring 64 is compressed because bushing 60 is locked into position (and shoulder 63 cannot yield) by operation of inserted fork 66. FIG. 10 shows this state and condition. Note the difference between FIGS. 10 and 4; in FIG. 4 plunger 50 is freely suspended in the casement and locked, but locking of the bushing makes no difference as to the relative disposition of the parts. In FIG. 10, however, flared tube 20 is urged against the balls 48 which engage frustocone 54 and have shifted the plunger 50 up a little, thereby compressing the spring 64 and lifting nut 70 off the bushing 60. The latter remains locked by the fork 66. On the other hand, any load changes during manipulation of the slab causes the spring 64 to reliently react, rocking the plunger a little back and forth. This prevents the heavily loaded balls 48 from indenting the head 54.

The device can be released as follows. The first step is to pull fork 66 out of the slots 49*a,* by means of a rope or cable 67, which, in turn, engages a loop 68 of lanyard tying lever 73 to the fork 66. However, it should be mentioned that this release will be carried out only when the coupling is no longer under load. Thus, spring 64 has already decompressed. As fork 66 releases the bushing 60, lever 73 is released from being clamped between bushing 60 and casement 40. As the operator pulls on rope or cable 67, he angles the lever 73 and pries loose the plunger 50. As he pulls on the cable 67, he now can pull the plunger 50 out sufficiently far so that cone 53 radially aligns with balls 48 permitting them to retract. The springs 81 are now permitted to decompress and lift the shackle elements 75, 77, the casement 40 still being inserted in the shackle. The force of the springs 81 is preferably compatible to the weight of the shackle-plus-casement-plus-plunger assembly so that the decompressed springs 81 do, in fact, lift this assembly. Moreover, any frictional engagement of the casement with the tube 30 should also be overcome by the springs 81. The casement 40 can readily be pulled out of insert 20 and hangs on plate 75, in that the nut 45 suspends the casement from sleeve 79. Shackle and casement will now be freed entirely from the concrete slab and pulled up.

The invention is not limited to the embodiments described above but all changes and modifications thereof not constituting departures from the spirit and scope of the invention are intended to be included.

We claim:

1. A coupling for selectively effecting a releasable connection to a concrete slab having an opening, comprising:

a tubular element in said opening having a frustoconically flared portion facing the interior of the slab, further having a cylindrical neck portion extending from a smallest diameter portion of the flared portion;

a base embedded in the slab, including means for positioning the tubular element, the tubular element being surrounded by concrete in the slab and in engagement with a correspondingly flared portion of the opening in the slab, for retaining the tubular element in the concrete;

a casement of elongated tubular construction having a front end and a rear end, there being a plurality of laterally extending openings in the casement;

a plurality of freely inwardly and partially radially outwardly displaceable balls in the openings;

a plunger with a head and a conical tip in the casement being axially moveable therein, the plunger upon being partially retracted in the casement permitting the balls to retract into the opening, at least sufficiently far enough so that the casement can clear said neck portion, the plunger upon advancing having its tip radially displacing the balls for protraction, the head holding the balls in protracting position; and releasable means, accessible near the rear end of the casement for retaining the plunger and the head in the advanced position.

2. A coupling as in claim 1, said means for retaining the plunger including a bushing mounted to the plunger at the rear end of the casement and having recess means, said casement having at least one recess at said rear end, and a fork pin in said recess and said recess means to hold the bushing in a particular position in which the head of the plunger causes the balls to protract.

3. A coupling as in claim 2, and including a prying lever interposed between a shoulder of the bushing and the casement to pull the plunger partially out of the casement.

4. A coupling as in claim 1, said base having a plurality of corner elements, a web structure and an annular flange, said tubular element being fastened to said flange.

5. A coupling as in claim 1, wherein the means for retaining includes means for restraining the plunger in an advanced position and means for obtaining external release of the restraining means to thereby free the plunger from the advanced position.

6. A coupling as in claim 5, including resilient means for biasing the plunger for obtaining retraction of the plunger by relief of the resilient means as said means for restraining is externally released.

7. A coupling as in claim 6, including a shackle pivoted on a plate, the plate having an aperture, the casement having an outer threading, and a nut element threaded onto the casement and holding the plate against the slab as the casement front is inserted in the embedded tubular element.

8. A coupling as in claim 7, including resilient means bracing the shackle plate away from the slab, so that upon freeing the plunger from the means for retaining, the shackle plate with casement is lifted off the slab.

9. A coupling as in claim 6, including a self-setting shear tube extending out of shackle plate alongside the casement.

10. In a coupling for effecting a releasable connection with a concrete slab, the coupling including an anchor part embedded in the slab and having a surface against which locking means may bear; a releasable coupling member for insertion into and retraction from the anchor part, comprising:

a hollow casement having on one front end a plurality of lateral openings;

a plurality of balls respectively retained in said openings;

a plunger having a head, a conical tip on the head, and a stem extending rearwardly from the head, the plunger being disposed in the casement, so that in a first position the head is disposed adjacent to the openings causing the balls to laterally protrude from the casement for bearings against the locking means, the balls being held without being connected to the head, and in a second position the head is displaced in rearward direction from the front end of the casement to permit retraction of the balls for partial protrusion into the hollow interior of the casement, the conical tip of the head displacing the balls radially outwardly in the openings upon moving the plunger from the second to the first position;

retaining means connected to the stem of the plunger, to the rear of the head; and externally accessible, releasable means for locking the retaining means to the casement in the first position of the plunger and for releasing the retaining means from the casement, so that the plunger can return to the second position.

11. In a coupling as in claim 10, said retaining means being a bushing held on the stem; fastening means preventing the bushing from being slipped off the stem;

said bushing and said casement having alignable recesses to receive the releaseable means for locking the bushing to the casement.

12. In a coupling as in claim 10 or 11, said plunger having a frusto-conical portion with a steep apex angle, the conical tip extending from the frustoconical portion having a shallower apex angle, said frustoconical portion engaging the balls when the plunger is in the first position, the coupling further including spring means being compressed when the balls tend to move the plunger from the first position.

13. In a coupling as in claim 12, including a shoulder means seated on a shoulder in the plunger, said spring being interposed between the shoulder means and the retaining means.

14. In a coupling as in claim 11, and including a prying lever interposed between said bushing and the casement.

15. In a coupling for effecting a releasable connection to a concrete slab, the coupling including a releasable coupling member, an anchor part, comprising:

a tubular member having a cylindrical neck from which extends an outwardly flaring, frusto-conical portion and being embedded in the concrete slab in that the concrete surrounds all of the flared portions, any axial force exerted by the coupling member upon the tubular member, being directly reacted laterally by the flared portion into the surrounding concrete.

16. In a coupling as in claim 15, including hold down means engaging the wide end portion of the frusto-conical position and tying it down, the hold down means being also embedded in the concrete, the interior space of the tubular member being open to receive the releasable coupling member.

17. In a coupling as in claim 16, and including a sleeve seated on the neck portion to maintain a concrete-free access to the tubular member and providing tying means for attaching the assembly to substructure.

18. In a coupling as in claim 16, said coupling member having laterally retractable and protractable balls operated by a reciprocating plunger, said balls engaging the flared portion of the tubular member from the inside.

19. In a coupling as in claim 16, said hold down means including a base with corner elements interconnected by a web carrying an annular flange, said tubular member being seated on the flange, the hold down means further including annular means fastening the tubular member to the flange, the corner element provided for tying the base to substructure in the concrete.

20. A coupling for selectively effecting a releasable connection to a concrete slab having an opening, comprising:

a tubular element in said opening having a frusto-conically flared portion facing the interior of the slab, further having a cylindrical neck portion extending from a smallest diameter portion of the flared portion;

means for holding the tubular element embedded in the concrete slab;

a casement of elongated tubular construction having a front end and a rear end, there being a plurality of laterally extending openings in the casement, said casement being provided for receiving a lock element near the rear end;

a plunger with a head and a conical tip in the casement being axially movable therein, the plunger upon being partially retracted in the casement permitting the balls to retract into the opening, at least sufficiently far enough, so that the casement can clear said neck portion, the plunger upon advancing having its tip radially displacing the balls for protraction, the head holding the balls in protracting position;

means at the end of the plunger opposite the head and being provided for receiving such a lock element when the plunger is in an advancing position; and a releasable lock element for locking the plunger to the casement when received by the plunger and the casement.

21. In a coupling as in claim 10 or 20, said plunger having a frusto-conical portion with a steep apex angle, for engaging the balls in the first position, the conical tip extending from the frusto-conical portion and having a shallower apex angle.

22. A coupling as in claim 1, or 20 said head having a steep-angle, frusto-conical portion engaging the balls, the balls pushing the plunger up, there being a resilient means provided in the casement for being biased when the loaded balls tend to push the plunger up.

23. A coupling as in claim 20, and including a a prying lever interposed between the structure at the opposite end of the plunger and the casement, to pull to plunger at least partically out of the casement following removal of the lock element.

* * * * *